United States Patent [19]

Beniek

[11] Patent Number: 4,592,704

[45] Date of Patent: Jun. 3, 1986

[54] MOTOR WITH IMPROVED LOW-SPEED OPERATION

[75] Inventor: George S. Beniek, Chanhassen, Minn.

[73] Assignee: Eaton Corporation, Cleveland, Ohio

[21] Appl. No.: 767,667

[22] Filed: Aug. 21, 1985

Related U.S. Application Data

[63] Continuation of Ser. No. 586,378, Mar. 5, 1984, abandoned.

[51] Int. Cl.[4] ..... F03C 2/08; F16K 3/26

[52] U.S. Cl. ..... 418/61 B; 137/625.21

[58] Field of Search ..... 418/61 B; 137/625.21

[56] References Cited

U.S. PATENT DOCUMENTS

| | | | |
|---|---|---|---|
| 3,473,437 | 10/1969 | Ohrberg | 91/56 |
| 3,514,234 | 5/1970 | Albers et al. | 418/61 |
| 3,606,598 | 9/1971 | Albers | 418/61 B |
| 4,106,883 | 8/1978 | Hansen et al. | 418/61 |
| 4,171,938 | 10/1979 | Pahl | 418/61 B |
| 4,343,600 | 8/1982 | Thorson | 418/61 |

*Primary Examiner*—John J. Vrablik
*Assistant Examiner*—Theodore W. Olds
*Attorney, Agent, or Firm*—C. H. Grace; L. J. Kasper

[57] ABSTRACT

An improved rotary fluid pressure device is provided of the type especially suited for operation at relatively low speed. The device includes a gerotor gear set (13) having a star (27) which orbits and rotates, an output shaft (47) and a main drive shaft (51) to transmit rotation of the star to the output shaft. The valving comprises a spool valve member (49) defining axial ports (65) and (67) connected to the inlet and outlet, respectively, and stationary ports (41) communicating with the gerotor volume chambers. The stationary ports (41) have a port width $W_1$ and the axial ports (65) and (67) have port widths $W_2$ which is narrower than $W_1$ and is selected such that the measured maximum cross-port leakage rate is approximately equal to the minimum rate. Because the cross-port leakage is kept constant, the flow to the gerotor is constant, resulting in optimized low-speed operation of the motor.

8 Claims, 4 Drawing Figures

MOTOR WITH IMPROVED LOW-SPEED OPERATION

CROSS-REFERENCE TO RELATED APPLICATION

This application is a continuatin of U.S. application Ser. No. 586,378, filed Mar. 5, 1984, now abandoned.

BACKGROUND OF THE DISCLOSURE

The present invention relates to rotary fluid pressure devices, and more particularly, to valving for such devices which results in substantially improved low-speed operation.

Although the invention may be used with devices having various types of fluid energy-translating displacement mechanisms, the invention is especially adapted for use in a device including a gerotor gear set, and will be described in connection therewith.

Fluid motors of the type utilizing a gerotor gear set to convert fluid pressure into a rotary output have become popular and are especially suited for low-speed, high-torque applications. In one of the most common designs of such motors, the housing defines inlet and outlet ports and a cylindrical valve bore, and the motor further includes a hollow, cylindrical spool valve which is integral with an output shaft. The well known commutating valve action necessary to communicate pressurized fluid to the expanding volume chambers of the gerotor set, and communicate exhaust fluid from the contracting volume chambers, occurs at the interface of the valve bore and the valve spool.

As is well known to those skilled in the art, commutating valving for use with a low-speed, high-torque (LSHT) gerotor motor requires a stationary valve member and a rotary valve member. Typically, if the gerotor gear set includes N+1 internal teeth and N external teeth, the stationary valve will define N+1 ports (each of which communicates with one of the volume chambers of the gerotor), and the rotary valve defines N fluid ports (in communication with the pressurized motor inlet). Fluid motors and commutating valving of the type to which this invention relates are illustrated and discussed in greater detail in U.S. Pat. No. 3,514,234, assigned to the assignee of the present invention and incorporated herein by reference. Typically in such motors, both the stationary ports and the rotary valve ports have a port width $W_1$. At the same time, the sealing lands between the ports on the rotary valve have a width which is also equal to $W_1$. Such an arrangement is referred to as "zero lap porting," i.e., a stationary port can be disposed between adjacent high-pressure and low-pressure rotary ports, and in line-to-line contact with each, without actually being in fluid communication with either (see FIG. 2). In an increasing number of applications for LSHT gerotor motors, it has become desirable to operate the motor at extremely low flows and speeds, such as several rpm. Prior to the present invention, when LSHT gerotor motors were operated at such low speeds, the motor either stalled or operated with a very uneven output speed. It is believed that such operation is the result of cross-port leakage (i.e., leakage from a pressurized rotary port through an adjacent stationary port and into the adjacent low-pressure rotary port). With zero lap porting as used in the prior art, there is sufficient time for such cross-port leakage to occur while the motor is operated at very low speeds.

SUMMARY OF THE INVENTION

In the past, it was recognized by those skilled in the art that such cross-port leakage could be reduced by making either the rotary ports or the stationary ports narrower. However, it was believed that making one of the sets of ports narrower would result in "starving" the volume chambers, i.e., being unable to provide sufficient fluid to the pressurized, expanding volume chambers, and that this would result in rough, jerky operation of the motor. Also, as is generally known to those skilled in the art, the use of such narrow ports ("underlapped" porting), results in an increased pressure drop from the motor inlet port to the outlet port, thus reducing the overall mechanical efficiency of the motor.

Accordingly, it is an object of the present invention to provide a rotary fluid pressure device having valving which substantially improves low-speed performance, i.e., smooth, consistent shaft rotation without stalling.

It is a more specific object of the present invention to provide a device which achieves the above-stated object, but without having an excessive pressure drop across the device, whereby the overall mechanical efficiency of the device is maintained.

The above and other objects of the present invention are accomplished by the provision of a rotary fluid pressure device, especially adapted for operation at relatively low speed, of the type including housing means defining fluid inlet and outlet ports and having a fluid energy-translating displacement mechanism associated with the housing means. The mechanism includes an internally-toothed member and an externally-toothed member eccentrically disposed therein. One of the toothed members rotates about its own axis and one of the members orbits about the axis of the other. The teeth of the members interengage to define expanding and contracting fluid volume chambers during such movement. The device has valve means including a stationary valve member defining a plurality N+1 of stationary fluid ports, each of which is in continuous fluid communication with one of the volume chambers. Each of the stationary ports has a port width $W_1$. The valve means further includes a rotary valve member operable to rotate in synchronism with the toothed member having rotational movement. The rotary valve member defines a fluid chamber in communication with the inlet port and a plurality N of rotary fluid ports in communication with the fluid chamber. Each of the rotary fluid ports has a port width $W_2$.

The device is characterized by one of the port widths $W_1$ and $W_2$ being selected, relative to the other, to be narrower than the other to such an extent that the maximum measured leakage, during rotation of said rotary valve member, is approximately equal to the minimum measured leakage. This relationship of $W_1$ and $W_2$ minimizes leakage fluctuation during relatively low-speed operation, whereby performance during such low-speed operation is optimized.

DESCRIPTION OF THE PREFERRED EMBODIMENT

Figure 1:
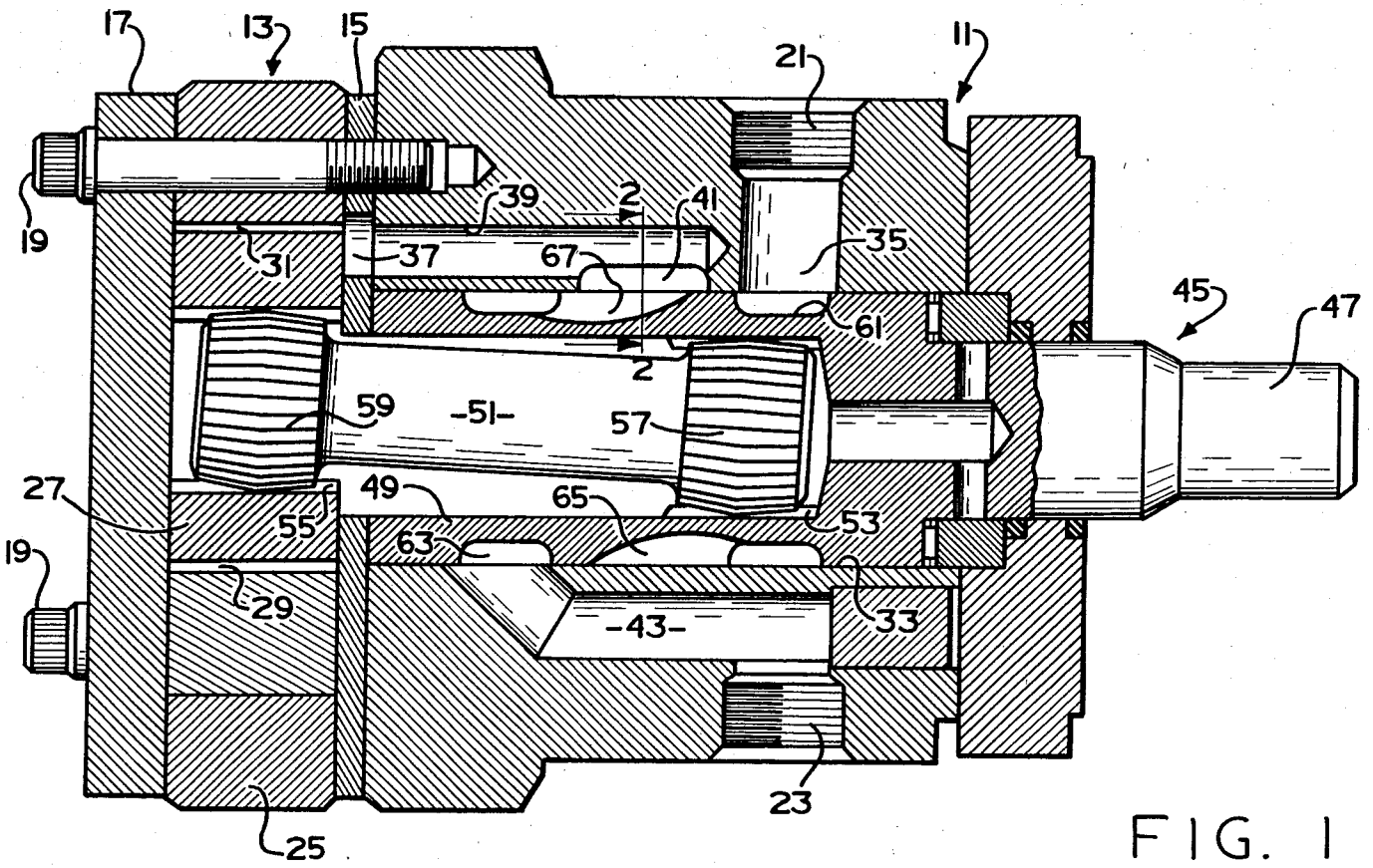
FIG. 1 is an axial cross-section of a LSHT gerotor motor of the type with which the present invention may be utilized.

Referring now to the drawings, which are not intended to limit the invention, FIG. 1 is an axial cross-section of a fluid motor of the type to which the present invention may be applied, and which is described in greater detail in previously incorporated U.S. Pat. No. 3,514,234. The LSHT motor of FIG. 1 is generally cylindrical and comprises several distinct sections. The motor comprises a valve housing section 11, a fluid energy-translating displacement mechanism 13 which, in the subject embodiment, is a roller gerotor gear set, and a port plate 15 disposed between the housing section 11 and gear set 13. Disposed adjacent the gear set 13 is an end cap 17, and the housing section 11, port plate 15, gear set 13, and end cap 17 are held together in fluid sealing engagement by a plurality of bolts 19.

The valve housing section 11 includes a fluid port 21 and a fluid port 23. The gerotor gear set 13 includes an internally-toothed ring member 25, through which the bolts 19 pass, and an externally-toothed star member 27. The teeth of the ring 25 and star 27 interengage to define a plurality of expanding volume chambers 29, and a plurality of contracting volume chambers 31, as is well known in the art.

The valve housing section 11 defines a spool bore 33 and a fluid passage 35 which provides continuous fluid communication between the fluid port 21 and the bore 33. In fluid communication with each of the volume chambers 29 and 31 is an opening 37 defined by the port plate 15, and in fluid communication with each of the openings 37 is an axial passage 39 (see also FIGS. 2 and 3), drilled in the housing section 11. Each of the axial passages 39 communicates with the spool bore 33 through a port 41 which, typically, is milled during the machining of the housing section 11. The housing section 11 also defines a fluid passage 43 which provides communication between the spool bore 33 and the fluid port 23.

Disposed within the spool bore 33 is an output shaft assembly, generally designated 45, including a shaft portion 47 and a spool valve portion 49. Disposed within the hollow, cylindrical spool valve portion 49 is a main drive shaft 51, commonly referred to as a "dog-bone" shaft. The output shaft assembly 45 defines a set of straight, internal splines 53 and the star 27 defines a set of straight, internal splines 55. The drive shaft 51 includes a set of external, crowned splines 57 in engagement with the internal splines 53, and a set of external, crowned splines 59 in engagement with the internal splines 55.

The spool valve portion 49 defines an annular groove 61 in continuous fluid communication with the fluid port 21 through the passage 35. Similarly, the spool valve 49 defines an annular groove 63 which is in continuous fluid communication with the fluid port 23, through the passage 43. The spool valve 49 further defines a plurality of axial ports 65 in communication with the annular groove 61, and a plurality of axial ports 67 in communication with the annular groove 63. The axial ports 65 and 67 are also frequently referred to as axial feed slots. As is generally well known to those skilled in the art, the axial ports 65 provide fluid communication between the annular groove 61 and the ports 41 disposed on one side of the line of eccentricity of the gerotor set 13, while the axial ports 67 provide fluid communication between the annular groove 63 and the slots 41 which are on the other side of the line of eccentricity. The resulting commutating valve action between the axial ports 65 and 67 and the slots 41, as the spool valve 49 rotates, is well known in the art, is described in great detail in previously incorporated U.S. Pat. No. 3,514,234, and will not be generally described further herein.

Valving

Figure 2:
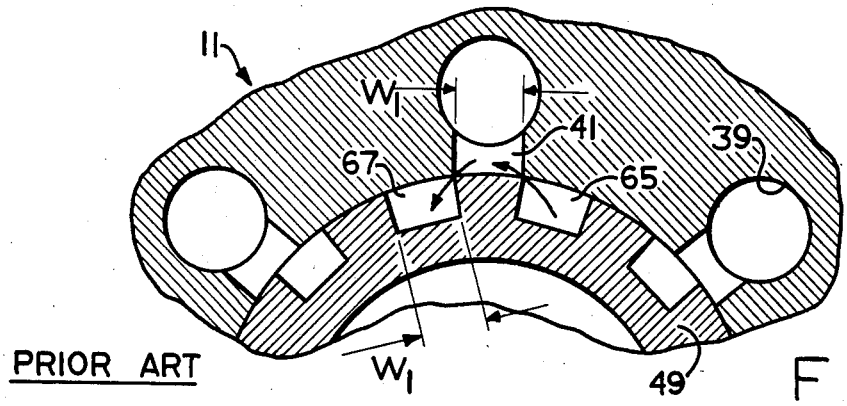
PRIOR ART FIG. 2
FIGS. 2 and 3 are enlarged, fragmentary transverse crosssections taken on line 2—2 of FIG. 1, FIG. 2 illustrating the PRIOR ART and FIG. 3 illustrating the present invention.
Figure 3:
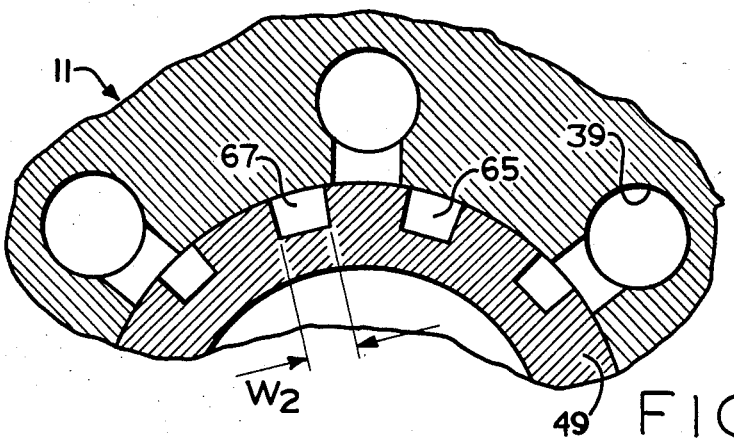

Referring now to FIGS. 2 and 3 in conjunction with FIG. 1, it may be seen that in the PRIOR ART version of the motor shown in FIG. 1, the ports 41 had a width $W_1$ while each of the axial ports 65 and 67 also had a width $W_1$. As a result, about $(N+1)$ times per rotation of the spool valve 49, the spool valve 49 would occupy a position, such as shown in FIG. 2, wherein one of the stationary ports 41 would be in line-to-line contact with an adjacent axial port 65 and an adjacent axial port 67, at the same time. Assuming for purposes for further description that the fluid port 21 is pressurized and the fluid port 23 is the motor outlet port, connected to the system reservoir, it may be seen that the prior art condition illustrated in FIG. 2 would, at the shown instant in FIG. 2, permit cross-port leakage from the pressurized axial port 65, through the stationary port 41, to the low-pressure axial port 67.

It was discovered during the development of the present invention, however, that the cross-port leakage described above is not continuous. Instead, it was discovered that as the spool valve 49 is rotated, using these PRIOR ART zero lap valving of FIG. 2, the cross-port leakage varies between a maximum leakage and a minimum leakage, as shown on the graph of FIG. 4, by the points labeled "PRIOR ART." As one aspect of the present invention, it has been realized that the rough low-speed operation of the prior art is related to the cross-port leakage rate. Assuming a constant flow of pressurized fluid into the motor at port 21, the flow rate into the expanding volume chambers of the gerotor set 13 is merely the input flow rate minus the instantaneous cross-port leakage rate. Therefore, if the cross-port leakage rate fluctuates between maximum and minimum rates, the rate of flow to the gerotor also fluctuates, resulting in a rough, fluctuating output shaft speed.

Referring now to FIG. 3, the improved valving of the present invention is illustrated. In FIG. 3, the stationary ports 41 still have a port width $W_1$, but in accordance with the present invention, the axial ports 65 and 67 have port widths $W_2$, wherein $W_2$ is less than $W_1$. As will be apparent to those skilled in the art, each of the sealing lands defined by the spool valve 49 (i.e., the area between adjacent axial ports 65 and 67), is increased in width by an amount equal to the decrease in the width of the ports 65 and 67. The result is a valving arrangement which may be referred to as "underlapped" valving or "overlapped" sealing.

However, as indicated in the background of the specification, simply to make the ports 65 and 67 narrower than the ports 41 is already known to those skilled in the art. Instead, it is an essential feature of the present invention that the reduction in the width of the ports 65 and 67 be to such an extent that, during rotation of the spool 49, the maximum leakage rate is approximately equal to the minimum leakage rate. Such a relationship of the widths $W_1$ and $W_2$ minimizes leakage fluctuation during relatively low-speed operation, to optimize motor performance during such low-speed operation. The optimum port width $W_2$, as it relates to the port width $W_1$, can be determined experimentally, and such determination is an important aspect of the present invention. Preferably, this determination of the optimum port width $W_2$, for a particular given motor design and port width $W_1$, can be determined by providing a motor as shown in FIG. 1 and a series of different spool valves 49. Each of the spool valves 49 should be identical except for the width $W_2$ of the axial ports 65 and 67.

In one of the motors, the width $W_2$ of the ports 65 and 67 should be selected to be equal to $W_1$ in accordance with the PRIOR ART shown in FIG. 2. Maximum and minimum leakage rates should then be measured for the motor in which $W_2$ equals $W_1$, and these rates should be plotted, yielding the points labeled "PRIOR ART" in FIG. 4.

For purposes of this invention, the measurement of fluid leakage rate may be accomplished by removing the main drive shaft 51, the gerotor gear set 13, and the port plate 15 from the motor, then bolting the end cap 17 directly to the housing section 11 to seal off the ends of the axial passages 39. The inlet fluid port 21 is then pressurized at a known, constant pressure, but because the end cap is against the end of the housing 11, there is no substantial flow but only a slight amount of flow to make up for any leakage and maintain the desired pressure. Some sort of flow measurement arrangement is connected to the fluid outlet port 23, and the spool valve 49 is then rotated at a known, constant speed, preferably at approximately the speed corresponding to the desired low speed at which the motor will operate. As the spool valve 49 is rotated, the only fluid flowing out of the outlet port 23 is leakage within the motor, and the majority of such leakage is typically the cross-port leakage from axial port 65, through stationary port 41, to the axial port 67 as illustrated by the arrows in FIG. 2. It should be noted that the leakage rate measured by the above-described method does not necessarily indicate the rate of leakage that will occur in the motor during operation. As will be understood by those skilled in the art, for purposes of the present invention, it is not the absolute quantity of leakage fluid which is significant, but instead, the variation or difference between the minimum leakage rate and the maximum leakage rate as the spool valve 49 is rotated.

Figure 4:
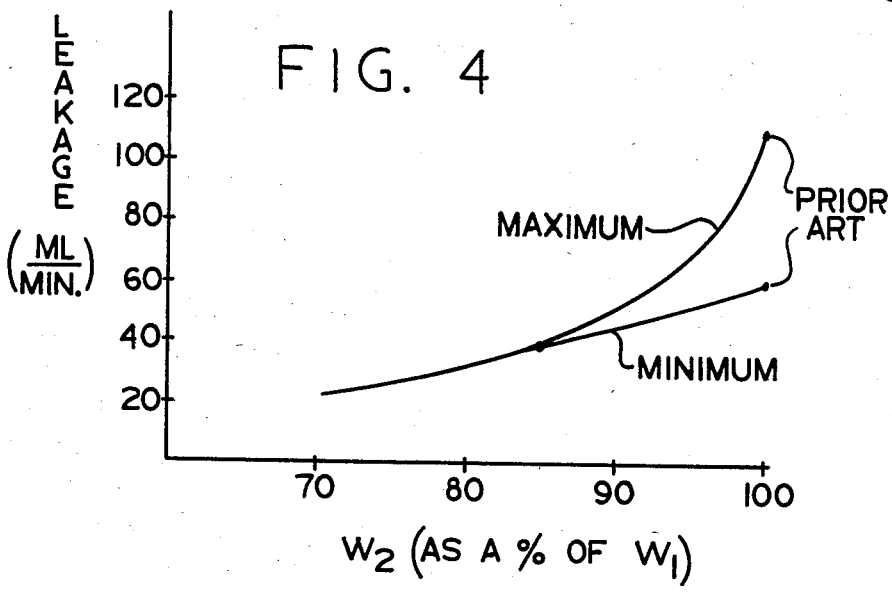
FIG. 4 is a graph of leakage versus port width which is used to implement the present invention.

Therefore, these minimum and maximum leakage rates as measured by the above-described method are plotted as shown in FIG. 4 for the case in which port width $W_2$ equals $W_1$, i.e., $W_2$ equals 100 percent of $W_1$. It is believed that the maximum leakage rate occurs just as a pair of the axial ports 65 and 67 reach the line-to-line communication with one of the stationary ports 41, with the maximum leakage rate occurring again when another pair of ports 65 and 67 reaches the same relationship (see FIG. 2) with another one of the ports 41, in accordance with well known commutating valving principles. Next, the spool valve is replaced by another which is identical except that the port width $W_2$ is slightly less than the port width $W_1$, e.g., $W_2$ equals 0.95 $W_1$. The minimum and maximum leakage rates for this spool valve are measured and plotted as described above. The procedure is then repeated several more times, each time using a spool valve in which the port width $W_2$ is slightly less than the port width $W_2$ of the spool valve in the preceding step.

As the procedure is repeated several times, it will be seen that the plot of minimum leakage rate and the plot of maximum leakage rate converge as shown in FIG. 4. At the point at which the two plots join, the minimum and maximum leakage rates are approximately equal, or in other words, the cross-port leakage rate becomes substantially constant. As described previously, if the cross-port leakage rate is constant, the flow of pressurized fluid into the expanding volume chambers 29 is also constant, resulting in orbital and rotational movement of the star 27 which is smooth and constant. Therefore, at that particular port width $W_2$, the low-speed performance of the motor is "optimized." If the port width $W_2$ were decreased even further, there would be a corresponding increase in the pressure drop or differential from the inlet port 21 to the outlet port 23 during normal motor operation. Such an increased pressure drop is undesirable because it represents a decrease in mechanical efficiency of the motor. Therefore, discussion herein of "optimized" low-speed motor performance refers to the selection of the port width $W_2$ such that the cross-port leakage is as nearly as constant as possible, without the pressure drop across the motor being any greater than necessary.

It should be apparent to those skilled in the art that, within the scope of the invention, it would be equally advantageous to maintain the axial ports 65 and 67 at the full port width $W_1$, and reduce the stationary ports 41 to some narrower width $W_2$, determined in accordance with the above-described procedure. In other words, it is within the scope of the present invention for either the rotary ports or the stationary ports to be made narrower to achieve the optimum low-speed performance which is the primary object of this invention.

It should also be noted that, within the scope of the invention, the procedure for determining the optimum port width $W_2$ may be carried out by starting with a spool valve 49 in which the axial ports 65 and 67 are quite narrow (e.g., where $W_2$ is equal to or less than 0.5 $W_1$), and progressively increasing the width of the axial slots 65 and 67, and plotting the leakage rates, until the leakage rate is no longer constant for a given port width $W_2$. In other words, the optimum port width $W_2$ would be determined by plotting the minimum and maximum leakage rates until the plots begin to diverge which is merely the opposite order of procedure from that described previously. The procedure for determining the optimum port width $W_2$ was described initially herein in terms of starting with $W_2$ equal to $W_1$ primarily because the resulting converging plots of minimum and maximum leakage rate provide a more useful illustration of the relationship between leakage fluctuation and port width $W_2$ (as a percent of port width $W_1$), than if the opposite procedure were utilized, starting with a very small port width $W_2$ and increasing from there.

EXAMPLE

Referring still to FIG. 4, in the subject embodiment of the present invention, the above-described procedure was utilized to determine an optimum slot width $W_2$ for a motor of the type shown in FIG. 1 which is currently being sold commercially by the assignee of the present invention. Throughout the test procedure, a pressure of 500 psi was maintained at the inlet port 21 of the motor. With the axial ports 65 and 67 having a port width equal to $W_1$, the measured leakage rate varied or fluctuated between a minimum of 60 ml per minute and a maximum rate of 110 ml per minute. As the width $W_2$ was progressively decreased, both the minimum and maximum leakage rates also decreased until the port width $W_2$ was reduced to 0.85 $W_1$. At this particular port width $W_2$, both the minimum and maximum leakage rates were reduced to a constant leakage rate of 40 ml per minute, but the pressure drop across the motor was still low enough to be acceptable. Therefore, in the subject embodiment, the low-speed performance of the motor was optimized with the port width $W_2$ equal to 85 percent of the port width $W_1$.

In order to check the actual operation of the motors, each of the spool valves involved in the above example was reassembled into a complete motor and operated with an input pressure of 500 psi and a sufficiently low flow rate to achieve an output speed of only several rpm. For the motor in which the port width $W_2$ was equal to $W_1$, the leakage fluctuations resulted in such uneven flow to the expanding volume chambers 31 of the gerotor set 13 that the output shaft 47 would not rotate. However, the motor in which the spool valve had the port width $W_2$ equal to 85 percent of $W_1$ had a substantially constant cross-port leakage as described above, and therefore a substantially constant flow of fluid to the gerotor, resulting in consistent rotation of the output shaft at the desired speed.

The present invention has been described in detail sufficient to enable one skilled in the art to make and use the same. It is believed that upon a reading and understanding of the foregoing specification, various alterations and modifications will occur to those skilled in the art, and it is intended that all such alterations and modifications be included in the invention, insofar as they come within the scope of the appended claims.

I claim:

1. A rotary fluid pressure device, especially adapted for operation at relatively low speed, of the type including housing means defining a fluid inlet port and a fluid outlet port; a fluid energy-translating displacement mechanism associated with said housing means and including an internally-toothed member and an externally-toothed member eccentrically disposed within said internally-toothed member, one of said members rotating about its own axis and one of said members orbiting about the axis of the other of said members, the teeth of said members interengaging to define expanding and contracting fluid volume chambers during said orbital and rotational movement; valve means including a stationary valve member defining a plurality N+1 of stationary fluid ports wherein N is equal to the number of teeth on the externally-toothed member, each of said stationary fluid ports being in continuous fluid communication with one of said fluid volume chambers, each of said stationary fluid ports having a port width $W_1$, said valve means further including a rotary valve member operable to rotate in synchronism with said one of said toothed members having rotational movement, said rotary valve member defining a fluid chamber in continuous fluid communication with said fluid inlet port and a plurality N of rotary fluid ports in communication with said fluid chamber, each of said rotary fluid ports having a port width $W_2$, characterized by:

one of said port widths $W_1$ and $W_2$ being selected, relative to the other, to be narrower than the other to such an extent that the maximum leakage, during rotation of said rotary valve member, is approximately equal to the minimum leakage to minimize leakage fluctuation during relatively low-speed operation, whereby performance during such low-speed operation is optimized.

2. A rotary fluid pressure device as claimed in claim 1 characterized by said fluid energy-translating displacement mechanism comprising a gerotor gear set, said internally-toothed member having a plurality N+1 of internal teeth and said externally-toothed member having a plurality N of external teeth.

3. A rotary fluid pressure device as claimed in claim 2 characterized by said internally-toothed member being fixed relative to said housing means and said externally-toothed member having said orbital and rotational movement relative to said internally-toothed member.

4. A rotary fluid pressure device as claimed in claim 1 characterized by said device including input-output shaft means extending from said housing means and rotatably supported thereby and main drive shaft means operable to transmit said rotational movement of said one of said toothed members to said input-output shaft means.

5. A rotary fluid pressure device as claimed in claim 4 characterized by said rotary valve member being operatively associated with said input-output shaft means to rotate therewith.

6. A rotary fluid pressure device as claimed in claim 1 characterized by said stationary valve member including said housing means defining a generally cylindrical valve bore surface, said valve bore surface defining said stationary fluid ports.

7. A rotary fluid pressure device as claimed in claim 6 characterized by said rotary valve member comprising a generally cylindrical spool valve member including a cylindrical outer surface defining said rotary fluid ports.

8. A rotary fluid pressure device as claimed in claim 1 characterized by said one of said port widths which is narrower than the other being selected to minimize the fluid pressure difference between said fluid inlet port and said fluid outlet port without permitting said minimum and maximum measured leakage to vary substantially from each other.

* * * * *